US009281662B2

(12) United States Patent
Takaoka et al.

(10) Patent No.: US 9,281,662 B2
(45) Date of Patent: Mar. 8, 2016

(54) SPARK PLUG

(71) Applicant: NGK SPARK PLUG CO., LTD., Nagoya-shi, Aichi (JP)

(72) Inventors: Katsuya Takaoka, Ichinomiya (JP); Kazuhiro Kurosawa, Komaki (JP); Kuniharu Tanaka, Komaki (JP); Haruki Yoshida, Tajimi (JP); Hirokazu Kurono, Nagoya (JP); Toshitaka Honda, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 14/723,506

(22) Filed: May 28, 2015

(65) Prior Publication Data

US 2015/0349498 A1 Dec. 3, 2015

(30) Foreign Application Priority Data

May 29, 2014 (JP) ..... 2014-110755

(51) Int. Cl.
*H01T 13/04* (2006.01)

(52) U.S. Cl.
CPC ..... *H01T 13/04* (2013.01)

(58) Field of Classification Search
CPC ..... H01T 13/04
USPC ..... 313/135, 141
See application file for complete search history.

(56) References Cited

U.S. PATENT DOCUMENTS

| | | | | | |
|---|---|---|---|---|---|
| 2,691,971 | A | * | 10/1954 | Dutterer | H01T 13/34 174/152 S |
| 3,882,341 | A | | 5/1975 | Green | 313/134 |
| 3,959,184 | A | | 5/1976 | Nemeth | 252/521 |
| 4,029,990 | A | | 6/1977 | Nagy et al. | 315/62 |
| 4,224,554 | A | | 9/1980 | Nishio et al. | 315/53 |
| 4,636,614 | A | * | 1/1987 | Itoh | F23Q 7/001 123/145 A |
| 5,210,458 | A | | 5/1993 | McDougal | 313/130 |
| 5,514,314 | A | | 5/1996 | McDougal | 264/61 |

FOREIGN PATENT DOCUMENTS

| | | | | |
|---|---|---|---|---|
| DE | 10004424 | A1 | 8/2001 | |
| DE | 102012218695 | A1 | 5/2014 | |
| EP | 2907207 | A1 | 8/2015 | |
| JP | S62-150681 | | 7/1987 | H01T 13/20 |
| JP | H02-284374 | A | 11/1990 | F02P 13/00 |
| JP | 2011-159475 | A | 8/2011 | H01T 13/20 |
| WO | WO 2014/060162 | A1 | 4/2014 | |

OTHER PUBLICATIONS

European Search Report issued in corresponding European Patent Application No. 15169602.8, dated Sep. 23, 2015.

* cited by examiner

*Primary Examiner* — Vip Patel
(74) *Attorney, Agent, or Firm* — Kusner & Jaffe

(57) ABSTRACT

A spark plug including an insulator having an axial hole, a center electrode held at one end side and a terminal electrode held at the other end side of the axial hole, an electrical connection portion electrically connecting the center electrode and the terminal electrode inside the axial hole, wherein the electrical connection portion includes a conductor including a ceramic phase and a metal wire having a spiral structure portion, wherein the metal wire has a wire diameter of 0.1 mm or greater and 0.5 mm or smaller, and wherein the spiral structure portion of the metal wire is configured such that an outer diameter thereof is 1.0 mm or greater and 3 mm or smaller, a pitch thereof is 0.3 mm or greater and 1 mm or smaller, and a height thereof is 8 mm or greater and 30 mm or smaller.

6 Claims, 6 Drawing Sheets

FIG.5A

| Sample No. | Configuration of conductor 63 | | | | | | | | Noise test (before endurance) | | | Noise test (after endurance) | | | Vibration test |
|---|---|---|---|---|---|---|---|---|---|---|---|---|---|---|---|
| | Spiral structure metal wire 63L | | | | | Ceramics phase 63C | | | | | | | | | |
| | Outer diameter (mm) | Pitch (mm) | Wire diameter (mm) | Height (mm) | Material | Ceramic material | Alkali amount (wt%) | Presence or absence of Si, B, P | 30 MHz | 100 MHz | 200 MHz | 30 MHz | 100 MHz | 200 MHz | NG rate (%) |
| S01 | 1.0 | 0.3 | 0.2 | 8 | Mo | $Al_2O_3$ | - | × | 56 | 48 | 39 | 66 | 56 | 48 | 18 |
| S02 | 3.5 | 1.0 | 0.1 | 22 | W | $ZrO_2$ | - | × | 55 | 47 | 40 | 65 | 55 | 49 | 17 |
| S03 | 1.5 | 0.3 | 0.1 | 21 | Ti | $Al_6Si_2O_{13}$ | - | × | 54 | 47 | 40 | 64 | 55 | 49 | 16 |
| S04 | 2.8 | 1.5 | 0.3 | 30 | Al | $Mg_3Si_4O_{10}$ | - | × | 55 | 46 | 40 | 65 | 54 | 49 | 17 |
| S05 | 2.5 | 1.2 | 0.5 | 12 | Mo | $TiO_2$ | - | × | 55 | 47 | 39 | 65 | 55 | 48 | 18 |
| S06 | 2.8 | 0.9 | 0.4 | 18 | Ti | $Al_2Si_4O_{10}$ | - | × | 56 | 48 | 38 | 66 | 56 | 47 | 18 |
| S07 | 3.3 | 1.0 | 0.3 | 20 | Al | $CaMg(CO_3)_2$ | - | × | 55 | 48 | 39 | 65 | 56 | 48 | 17 |
| S08 | 2.5 | 0.7 | 0.2 | 22 | Al | $Mg_2SiO_4$ | - | × | 54 | 48 | 39 | 64 | 56 | 48 | 18 |
| S09 | 3.0 | 0.3 | 0.4 | 20 | Zn | $CaCO_3$ | - | × | 55 | 47 | 40 | 60 | 51 | 45 | 18 |
| S10 | 2.1 | 0.4 | 0.5 | 19 | Ag | $BaCO_3$ | - | × | 56 | 46 | 38 | 61 | 50 | 43 | 16 |
| S11 | 1.5 | 0.8 | 0.1 | 16 | Fe | MgO | - | × | 54 | 47 | 38 | 59 | 51 | 43 | 17 |
| S12 | 1.2 | 1.4 | 0.1 | 17 | Ni | $Ca_2SiO_4$ | - | × | 55 | 47 | 40 | 60 | 51 | 45 | 17 |
| S13 | 2.9 | 1.0 | 0.3 | 18 | Cr | $Cr_2O_3$ | - | × | 55 | 46 | 39 | 60 | 50 | 44 | 17 |
| S14 | 2.5 | 0.5 | 0.2 | 21 | Sn | MgO, $Al_2O_3$ | 0.05 | ○ | 55 | 46 | 40 | 60 | 50 | 45 | 8 |
| S15 | 2.2 | 0.6 | 0.3 | 22 | Cu | $ZrO_2$ | 0.08 | ○ | 55 | 47 | 38 | 60 | 51 | 43 | 6 |
| S16 | 3.1 | 0.5 | 0.2 | 23 | Permalloy | $TiB_2$, $TiO_2$ | 0.09 | ○ | 54 | 46 | 38 | 59 | 50 | 43 | 7 |
| S17 | 1.0 | 0.3 | 0.1 | 25 | Sendust | MgO, $Al_2O_3$, $ZrB_2$ | 0.10 | ○ | 48 | 40 | 32 | 49 | 40 | 32 | 0 |
| S18 | 3.5 | 0.5 | 0.3 | 27 | INCO600 | MgO, $ZrO_2$, TiC | 6.50 | ○ | 46 | 41 | 31 | 47 | 41 | 31 | 0 |
| S19 | 3.0 | 0.3 | 0.4 | 21 | Ni | $Al_2O_3$, $ZrO_2$ | 4.24 | ○ | 47 | 40 | 32 | 48 | 41 | 32 | 0 |
| S20 | 2.6 | 0.6 | 0.5 | 19 | Fe | MgO, $Y_2O_3$ | 0.72 | ○ | 48 | 40 | 31 | 48 | 40 | 32 | 0 |
| S21 | 2.4 | 0.5 | 0.5 | 18 | Ag | $Y_2O_3$ | 3.94 | ○ | 49 | 40 | 30 | 49 | 41 | 31 | 0 |

FIG.5B

| Sample No. | Configuration of conductor 63 | | | | | | | | Noise test (before endurance) | | | Noise test (after endurance) | | | Vibration test |
|---|---|---|---|---|---|---|---|---|---|---|---|---|---|---|---|
| | Spiral structure metal wire 63L | | | | | Ceramics phase 63C | | | | | | | | | |
| | Outer diameter (mm) | Pitch (mm) | Wire diameter (mm) | Height (mm) | Material | Ceramic material | Alkali amount (wt%) | Presence or absence of Si, B, P | 30 MHz | 100 MHz | 200 MHz | 30 MHz | 100 MHz | 200 MHz | NG rate (%) |
| S22 | 2.8 | 0.3 | 0.4 | 22 | SUS316 | FeO, Permalloy | 5.50 | o | 42 | 34 | 26 | 43 | 34 | 26 | 0 |
| S23 | 2.4 | 0.3 | 0.3 | 25 | SUS405 | $Fe_2O_3$ | 0.91 | o | 40 | 35 | 25 | 41 | 35 | 25 | 0 |
| S24 | 2.6 | 0.4 | 0.3 | 23 | INCO601 | FeO, $Fe_2O_3$ | 5.27 | o | 41 | 34 | 26 | 42 | 35 | 26 | 0 |
| S25 | 2.5 | 0.4 | 0.5 | 19 | Sendust | NiZn ferrite | 4.42 | o | 33 | 25 | 17 | 34 | 25 | 17 | 0 |
| S26 | 2.4 | 0.5 | 0.3 | 24 | Ag | MnZn ferrite | 3.28 | o | 31 | 26 | 16 | 32 | 26 | 16 | 0 |
| S27 | 2.7 | 0.3 | 0.4 | 26 | Fe | NiZn ferrite, MnZn ferrite | 5.85 | o | 32 | 25 | 17 | 33 | 26 | 17 | 0 |
| S28 | 2.2 | 0.4 | 0.4 | 27 | Cu | MnZn ferrite, $Fe_2O_3$ | 6.49 | o | 33 | 25 | 16 | 33 | 25 | 17 | 0 |
| S31 | 0.9 | 0.5 | 0.2 | 14 | Al | $ZrO_2$ | - | × | 62 | 58 | 49 | 72 | 66 | 58 | 24 |
| S32 | 3.6 | 0.3 | 0.3 | 18 | Mo | $Al_2O_3$ | - | × | 63 | 57 | 50 | 77 | 65 | 59 | 26 |
| S33 | 1.2 | 0.2 | 0.3 | 22 | W | $TiO_2$ | - | × | 66 | 63 | 59 | 80 | 69 | 64 | 30 |
| S34 | 1.8 | 1.6 | 0.5 | 19 | Ti | $Al_2O_3$, $ZrO_2$ | - | × | 68 | 64 | 58 | 79 | 72 | 69 | 28 |
| S35 | 2.5 | 0.8 | 0.09 | 21 | Ti | $CaCO_3$ | - | × | 65 | 59 | 52 | 80 | 74 | 69 | 48 |
| S36 | 3.0 | 1.0 | 0.6 | 20 | Mo | $MgCO_3$ | - | × | 66 | 61 | 57 | 79 | 73 | 65 | 32 |
| S37 | 2.2 | 0.6 | 0.2 | 31 | Mo | $BaCO_3$, $ZrO_2$ | - | × | 62 | 58 | 49 | 72 | 66 | 58 | 24 |
| S38 | 2.6 | 0.7 | 0.4 | 7 | Ti | TiC | - | × | 72 | 68 | 63 | 74 | 71 | 65 | 24 |
| S39 | 0.8 | 0.2 | 0.6 | 20 | Al | None | - | × | 68 | 62 | 59 | 78 | 78 | 69 | 94 |
| S40 | 3.0 | 0.6 | 0.3 | 21 | W | None | - | × | 44 | 40 | 35 | 48 | 43 | 40 | 92 |

SPARK PLUG

RELATED APPLICATION

This application claims priority from Japanese Patent Application No. 2014-110755 filed on May 29, 2014, the entire contents of which are incorporated herein by reference.

FIELD OF THE INVENTION

The present invention relates to a spark plug.

BACKGROUND OF THE INVENTION

In general, a spark plug for use in an internal combustion engine includes a tubular metal shell, a tubular insulator that is disposed in an inner hole of the metal shell, a center electrode that is disposed in an axial hole of the insulator at a tip end side, a terminal electrode that is disposed in the axial hole at the other end side, and a ground electrode of which one end is connected to a tip end of the metal shell and the other end faces the center electrode and forms a spark discharge gap. Furthermore, a spark plug is also known in which a resistor is provided between a center electrode and a terminal electrode inside an axial hole for the purpose of preventing radio wave noise generated in accordance with an operation of an engine.

In recent years, in connection with an increase in an output of the internal combustion engine, an increase in a discharge voltage of the spark plug has been required. If the discharge voltage of the spark plug is increased, high frequency noise generated during discharging increases and there is a concern that high frequency noise brings a bad influence to an electronic control device of a vehicle. Thus, it is preferable that high frequency noise of the spark plug is reduced.

In order to reduce high frequency noise during discharging of the spark plug, various techniques are proposed in the related art. For example, JP-A-2011-159475 discloses a configuration in which a noise reduction member formed of a cylindrical ferrite is provided so as to surround a periphery of a conductor passing through an inside of a spark plug. Furthermore, JP-A-H02-284374 discloses a configuration in which wiring is provided an inside of a spark plug.

Further improvement in a material or a shape of a conductive member electrically connecting between the center electrode and the terminal electrode in the axial hole, so as to reduce high frequency noise is desirable.

The invention is provided to address the problems described above and can be realized in the following aspects.

SUMMARY OF THE INVENTION

According to an aspect of the invention, there is provided a spark plug including: an insulator having an axial hole extending in an axial direction; a center electrode held at one end side of the axial hole; a terminal electrode held at the other end side of the axial hole; an electrical connection portion electrically connecting the center electrode and the terminal electrode inside the axial hole; and a metal shell accommodating the insulator, wherein the electrical connection portion includes a conductor including a ceramic phase and a metal wire having a spiral structure portion, wherein the metal wire has a wire diameter of 0.1 mm or greater and 0.5 mm or smaller, and wherein the spiral structure portion of the metal wire is configured such that an outer diameter thereof is 1.0 mm or greater and 3 mm or smaller, a pitch thereof is 0.3 mm or greater and 1 mm or smaller, and a height thereof is 8 mm or greater and 30 mm or smaller.

Accordingly, since the metal wire has a spiral structure portion, a noise reduction effect as an inductance component is provided, and further, there is no fear that the noise reduction effect is reduced with time as compared to a printed electrode, metal powder, carbon powder, and the like. Furthermore, although wire disconnection may occur due to vibration in a case of providing only the metal wire, since the metal wire is fixed by the ceramic phase, it is possible to reduce a possibility of the wire disconnection. If a wire diameter of the metal wire is 0.1 mm or greater, it is possible to make occurrence of wire disconnection difficult. If the wire diameter of the metal wire is greater than 0.5 mm, contact between the wire members is likely to occur when an oxide film is generated on a surface of the metal wire. Thus, the noise reduction effect as the inductance component may be insufficient. If an outer diameter of the spiral structure portion is 1.0 mm or greater, processing can be easily performed and cost thereof is reduced. Furthermore, if the outer diameter is 3 mm or smaller, the spiral structure portion can easily enter an axial hole of an insulator. Furthermore, if a pitch of the spiral structure portion is 0.3 mm or greater, a capacity component of the spiral structure metal wire can be sufficiently reduced, and if the pitch of the spiral structure portion is 1 mm or smaller, obtained sufficient number of windings can be obtained. Thus, the noise reduction effect as the inductance component can be sufficiently obtained. If a height of the spiral structure portion is 8 mm or greater, the noise reduction effect as the inductance component can be sufficiently obtained. If the height of the spiral structure portion is 30 mm or smaller, it is possible to easily manufacture the spiral structure portion and to reduce the cost thereof.

Moreover, the invention can be realized in various aspects. The invention can be realized in aspects of the spark plug, a manufacturing method of the spark plug, a manufacturing apparatus of the spark plug, a manufacturing system, and the like.

BRIEF DESCRIPTION OF THE DRAWINGS

FIG. 5A is a diagram illustrating configurations of various samples, results of a noise test and a vibration test; and FIG. 5B is a diagram illustrating the configurations of various samples, results of the noise test and the vibration test.

DETAILED DESCRIPTION OF THE PREFERRED EMBODIMENTS

A. The configuration of Spark Plug

Figure 1:
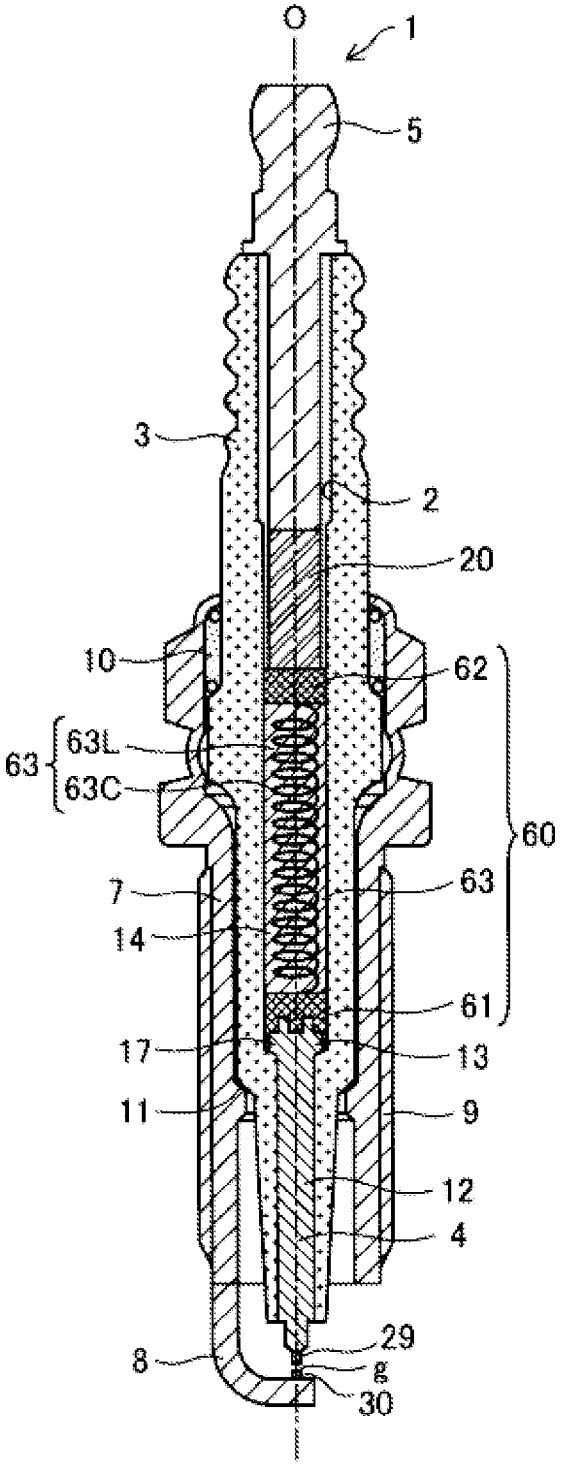
FIG. 1 is an explanatory view illustrating an entire configuration of a spark plug according to a first embodiment of the invention.

FIG. 1 is an explanatory view illustrating an entire configuration of a spark plug 1 according to a first embodiment of the invention. A lower side (firing portion side) of FIG. 1 is referred to as a leading end side of the spark plug 1 and an upper side (terminal side) is referred to as a rear end side. The spark plug 1 includes an insulator 3 having an axial hole 2 extending in an axial direction θ, a center electrode 4 that is held at the leading end side of the axial hole 2, a terminal electrode 5 that is held at the rear end side of the axial hole 2, an electrical connection portion 60 that electrically connects the center electrode 4 and the terminal electrode 5 inside the axial hole 2, a metal shell 7 that accommodates the insulator 3, and a ground electrode 8 of which one end is bonded to a leading end surface of the metal shell 7 and the other end is disposed so as to face the center electrode 4 with a gap therebetween.

The metal shell 7 has a substantially cylindrical shape and is formed so as to accommodate and hold the insulator 3. A screw portion 9 is formed on an outer peripheral surface of the metal shell 7 at the leading end side. The spark plug 1 is mounted on a cylinder head of an internal combustion engine (not illustrated) by using the screw portion 9.

The insulator 3 is held in an inner peripheral portion of the metal shell 7 through talc 10 and a packing 11. The axial hole 2 of the insulator 3 has a small diameter portion 12 that holds the center electrode 4 at the leading end side of an axial line O and an intermediate diameter portion 14 which accommodates the electrical connection portion 60 and which has an inner diameter is greater than an inner diameter of the small diameter portion 12. Furthermore, the axial hole 2 has a taper-shaped first step portion 13 that is enlarged toward the rear end side between the small diameter portion 12 and the intermediate diameter portion 14. The insulator 3 is fixed to the metal shell 7 in a state where an end portion of the insulator 3 at the leading end side protrudes from the leading end surface of the metal shell 7. It is preferable that the insulator 3 is formed of a material having mechanical strength, thermal strength, electrical strength, etc. For such a material, for example, a ceramic sintered body containing alumina as a main component is exemplified.

The center electrode 4 is accommodated in the small diameter portion 12, a large-diameter flange portion 17 provided at the rear end of the center electrode 4 is engaged with the first step portion 13, and the center electrode 4 is insulated and held with respect to the metal shell 7 in a state where the leading end thereof protrudes from a leading end surface of the insulator 3. It is preferable that the center electrode 4 is formed of a material having thermal conductivity, mechanical strength, etc., and for example, is formed of a Ni based alloy such as INCONEL (trade mark). A central axis portion of the center electrode 4 may be formed of a metal material having an excellent thermal conductivity such as Cu and Ag.

The ground electrode 8 is formed such that one end thereof is bonded to the leading end surface of the metal shell 7, an intermediate portion thereof is bent in an L-shape, and a leading end portion thereof faces the leading end portion of the center electrode 4 with a gap therebetween. The ground electrode 8 is formed of the same material as that forming the center electrode 4.

Noble metal tips 29 and 30 formed of a platinum alloy, an iridium alloy, and the like are respectively provided on surfaces of the center electrode 4 and the ground electrode 8, which face each other. A spark discharge gap g is formed between the noble metal tips 29 and 30. Here, either or both of noble metal tips of the center electrode 4 and the ground electrode 8 may be omitted.

The terminal electrode 5 is a terminal for applying a voltage from an outside to the center electrode 4 to perform spark discharge between the center electrode 4 and the ground electrode 8. A tip end portion 20 of the terminal electrode 5 includes a surface having an uneven shape, and in this embodiment, a knurling process is performed on an outer peripheral surface of the tip end portion 20. If the surface of the tip end portion 20 has an uneven structure that is formed by the knurling process, adhesiveness between the terminal electrode 5 and the electrical connection portion 60 is enhanced. As a result, the terminal electrode 5 and the insulator 3 are firmly fixed. The terminal electrode 5 is formed of, for example, low carbon steel and a Ni metal layer is plated on a surface thereof.

The electrical connection portion 60 is disposed between the center electrode 4 and the terminal electrode 5 inside the axial hole 2, and electrically connects the center electrode 4 and the terminal electrode 5. The electrical connection portion 60 includes a conductor 63 including a spiral structure metal wire 63L and a ceramics phase 63C, and the conductor 63 prevents occurrence of radio-wave noise. Furthermore, the electrical connection portion 60 has a first seal layer 61 between the conductor 63 and the center electrode 4, and a second seal layer 62 between the conductor 63 and the terminal electrode 5. The first seal layer 61 and the second seal layer 62 seal and fix the insulator 3 and the center electrode 4 and the insulator 3 and the terminal electrode 5.

The first seal layer 61 and the second seal layer 62 can be formed by sintering glass powder such as borosilicate soda glass and seal powder including metal powder such as Cu and Fe. A resistance value of the first seal layer 61 and the second seal layer 62 is typically hundreds of mΩ or smaller.

As will be described in detail later, the conductor 63 is a fired body that is formed by fixing a periphery of the spiral structure metal wire 63L formed of a conductive metal with the ceramics phase 63C. The spiral structure metal wire 63L is formed of a conductive metal wire material. The ceramics phase 63C is formed by firing various ceramics materials such as FeO, $Fe_2O_3$, $Al_2O_3$, and ferrite. That is, the conductor 63 is formed by forming the spiral structure metal wire 63L, and then inserting a material of the ceramics phase 63C in the periphery of the spiral structure metal wire 63L and firing it. It is possible to reduce high-frequency noise during discharge by providing the conductor 63 including the spiral structure metal wire 63L and the ceramics phase 63C. Here, it is preferable that both ends of the spiral structure metal wire 63L are directly connected to the first seal layer 61 and the second seal layer 62. Thereby, it is possible to prevent the resistance value of the conductor 63 from being greatly increased.

Configuration of Preferable Spiral Structure Metal Wire 63L

As a metal wire material forming the spiral structure metal wire 63L, it is possible to use a wire material formed by a metal or an alloy including one or more elements of Zn, Fe, Ni, Ag, Cr, Sn, and Cu. Particularly, an alloy wire material such as a Permalloy (Fe—Ni alloy), an Inconel (Ni—Cr—Fe alloy), and a Sendust (Fe—Si—Al alloy) can be used. If the spiral structure metal wire 63L formed of such a material is used, it is preferable that noise resistance properties are unlikely to be degraded with time. It is preferable that a wire diameter of the wire material of the spiral structure metal wire 63L is 0.1 mm or greater and 0.5 mm or smaller. It is preferable that dimensions of the spiral structure metal wire 63L are determined such that an outer diameter of a spiral structure portion is 1.0 mm or greater and 3 mm or smaller, a pitch of the spiral structure portion is 0.3 mm or greater and 1 mm or smaller, and a height of the spiral structure portion is 8 mm or greater and 30 mm or smaller. Since the spiral structure metal wire 63L has the spiral structure portion, the spiral structure metal wire 63L has a noise reduction effect as an inductance component and there is no concern that the noise reduction effect is decreased with time compared to a printed electrode, metal powder, carbon powder, and the like. Furthermore, although the wire disconnection may occur due to vibration in a case of providing only the metal wire, since the spiral structure metal wire 63L is fixed by the ceramics phase 63C, it is possible to reduce a possibility of wire disconnection of the spiral structure metal wire 63L. If the wire diameter of the spiral structure metal wire 63L is 0.1 mm or greater, it is possible to make occurrence of the wire disconnection of the spiral structure metal wire 63L difficult. Meanwhile, if the wire diameter of the spiral structure metal wire 63L is greater than 0.5 mm, contact between the wire materials is likely to occur when an oxide film is generated on a surface of the spiral structure metal wire 63L. Thus, the noise reduction effect as the inductance component may be insufficient. If the outer diameter of the spiral structure metal wire 63L is 1.0 mm or greater, processing can be further easily performed and a cost thereof is reduced. Furthermore, if the outer diameter of the spiral structure metal wire 63L is 3 mm or smaller, the spiral structure metal wire 63L can easily enter the axial hole 2 of the insulator 3. Furthermore, if the pitch of the spiral structure metal wire 63L is 0.3 mm or greater, a capacity component of the spiral structure metal wire 63L can be sufficiently reduced, and if the pitch of the spiral structure metal wire 63L is 1 mm or smaller, a sufficient number of windings is obtained. Thus, the noise reduction effect as the inductance component can be sufficiently obtained. If a height of the spiral structure metal wire 63L is 8 mm or greater, the noise reduction effect as the inductance component can be sufficiently obtained. If the height of the spiral structure metal wire 63L is 30 mm or smaller, it is possible to easily manufacture the spiral structure metal wire 63L and to reduce the cost thereof.

Preferable Material of Ceramics Phase 63C

For the material of the ceramics phase 63C, it is possible to use one or more kinds of power materials selected from the following various powder materials:

(a) Iron oxide such as FeO and $Fe_2O_3$ (b) Aluminum-containing oxide such as $Al_2O_3$, $Al_6Si_2O_{13}$, and $Al_2Si_4O_{10}$ (c) Magnesium-containing oxide such as $Mg_3Si_4O_{10}$, $CaMg(CO_3)_2$, $Mg_2SiO_4$, and MgO (d) Alkaline earth metal-containing material such as such as $BaCO_3$, $CaCO_3$, $Ca_2SiO_4$ (e) Zirconium-containing compound such as $ZrO_2$, and $ZrB_2$ (f) Titanium-containing material such as $TiO_2$, TiC, and $TiB_2$ (g) Other metal oxide such as $Y_2O_3$ and $Cr_2O_3$ (h) Ferromagnetic iron alloy such as Permalloy (i) Various ferrites such as Ni—Zn ferrite and Mn—Zn ferrite It is preferable that the ceramics phase 63C contains Fe-containing oxide having ferromagnetic properties such as ferrite. If the ceramics phase 63C contains the Fe-containing oxide having the ferromagnetic properties, it is possible to further increase the noise reduction effect of the conductor 63 as the inductance component. Furthermore, it is preferable that the ceramics phase 63C contains alkali-containing phase containing alkali metal oxide and oxide of one kind or more elements of silicon (Si), boron (B), and phosphorus (P). The alkali-containing phase can typically take a form formed by glass such as borosilicate soda glass. Since the alkali-containing phase has a function as a hollow hole filling material with which a plurality of hollow holes that may be formed in the ceramics phase 63C is filled and densified, it is possible to increase the noise reduction effect. Moreover, it is preferable that a content ratio of the alkali metal in the ceramics phase 63C is in a range of 0.1 wt % or greater and 6.5 wt % or smaller in terms of oxide. If the content ratio of the alkali metal is 0.1 wt % or greater in terms of oxide, it is possible to increase the effect of densifying the ceramics phase 63C and to reduce the possibility of the wire disconnection of the spiral structure metal wire 63L by a vibration test of the spark plug 1. Furthermore, since the content ratio of the alkali metal is 6.5 wt % or smaller, it is possible to suppress a phenomenon that the noise reduction effect is reduced due to a chemical reaction between the alkali metal and the spiral structure metal wire 63L.

Figure 2:
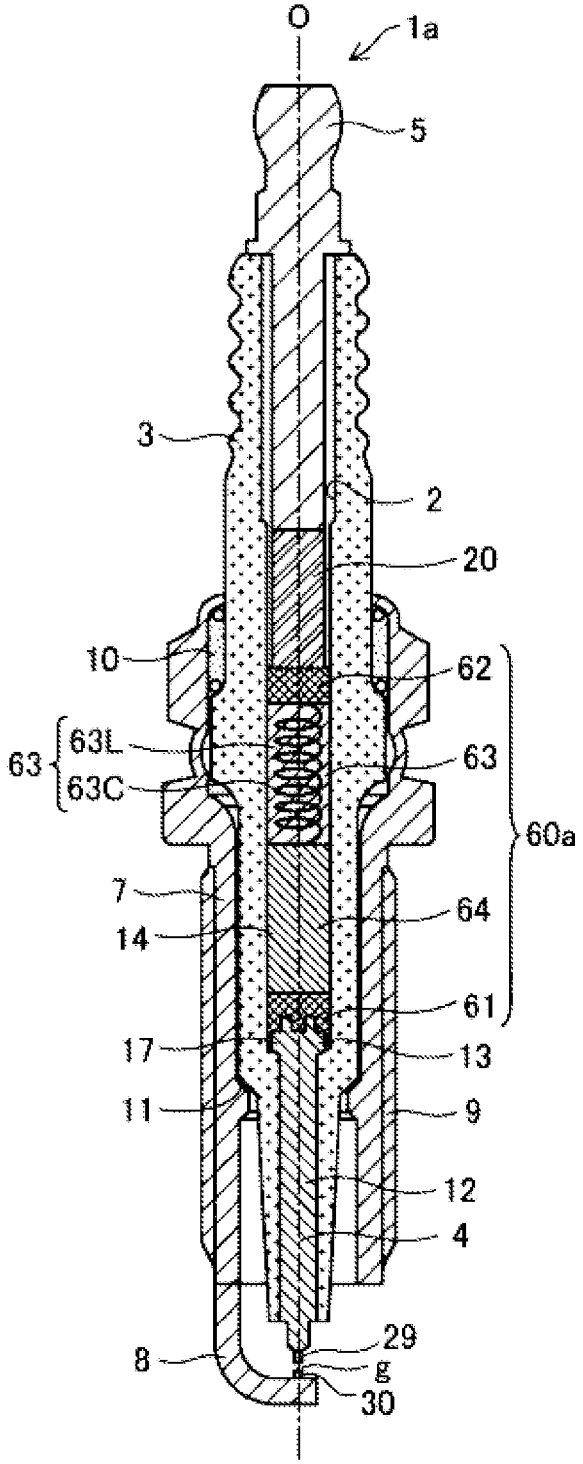
FIG. 2 is an explanatory view illustrating an entire configuration of a spark plug according to a second embodiment of the invention.

FIG. 2 is an explanatory view illustrating an entire configuration of a spark plug 1*a* according to a second embodiment of the invention. The configuration of the spark plug 1*a* is the same as that of the spark plug 1 of the first embodiment illustrated in FIG. 1 except that an electrical connection portion 60*a* of the spark plug 1*a* of the second embodiment has a resistor 64 in addition to the first seal layer 61, the second seal layer 62, and the conductor 63.

The resistor 64 can be formed by, for example, a resistance material that is formed by sintering a resistor composition containing glass powder such as borosilicate soda glass, ceramic powder such as $ZrO_2$, non-metallic conductive powder as carbon black, and/or metal powder such as Zn, Sb, Sn, Ag, and Ni. If the resistor 64 is also provided in addition to the conductor 63, since the noise reduction effect can be obtained by the resistor 64, it is possible to further improve the noise reduction effect.

In FIGS. 1 and 2, either or both of the first seal layer 61 and the second seal layer 62 of the electrical connection portion 60 may be omitted. However, since the seal layers 61 and 62 can relieve a difference in thermal expansion coefficients between the conductor 63 (and the resistor 64) and the terminal electrode 5 and the center electrode 4, which are positioned at both ends of the conductor 63, it is possible to obtain a further firm connection state. It is preferable that the resistance value between the terminal electrode 5 and the center electrode 4 is, for example, within a range of 3.0 kΩ or greater and 20.0 kΩ or smaller in the viewpoint of the noise reduction effect.

B. Forming Method of Electrical Connection Portion

Figure 3:
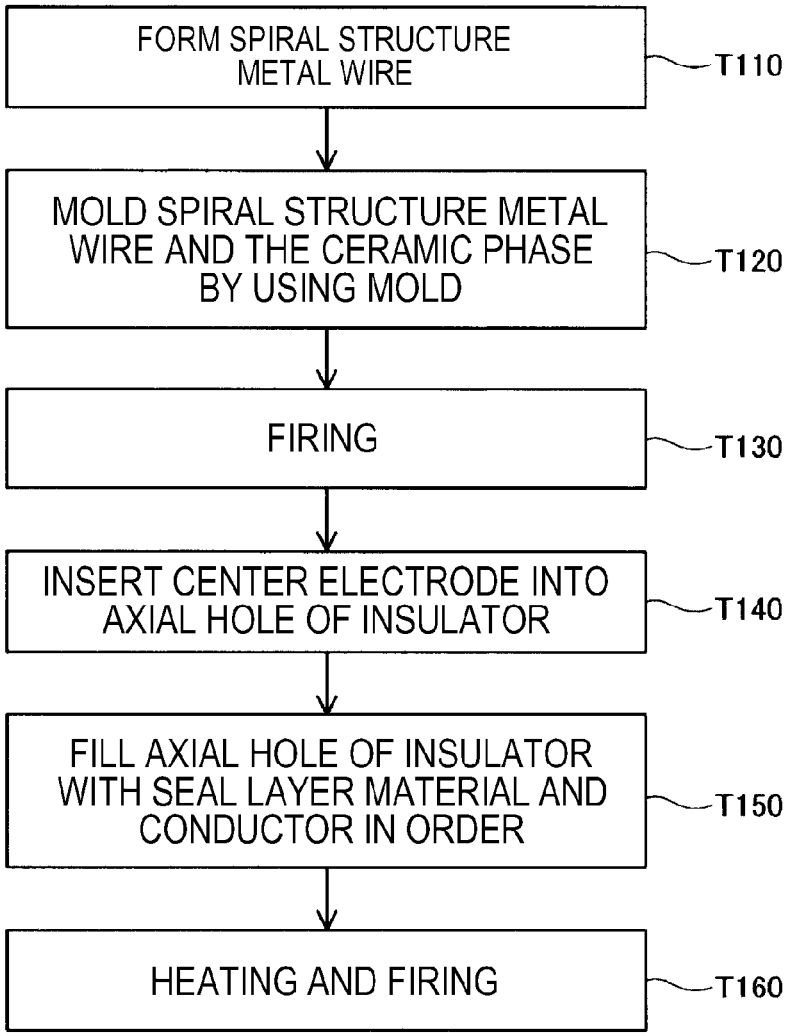
FIG. 3 is a flowchart illustrating a forming method of an electrical connection portion.

FIG. 3 is a flowchart illustrating a forming method of the electrical connection portion 60 of the spark plug 1. In process T110, the spiral structure metal wire 63L is formed by using the metal wire material so as to conform to the preferable dimension and shape described above. In process T120, the periphery of the spiral structure metal wire 63L is filled with powder material of the ceramics phase 63C by using the mold.

Figure 4:
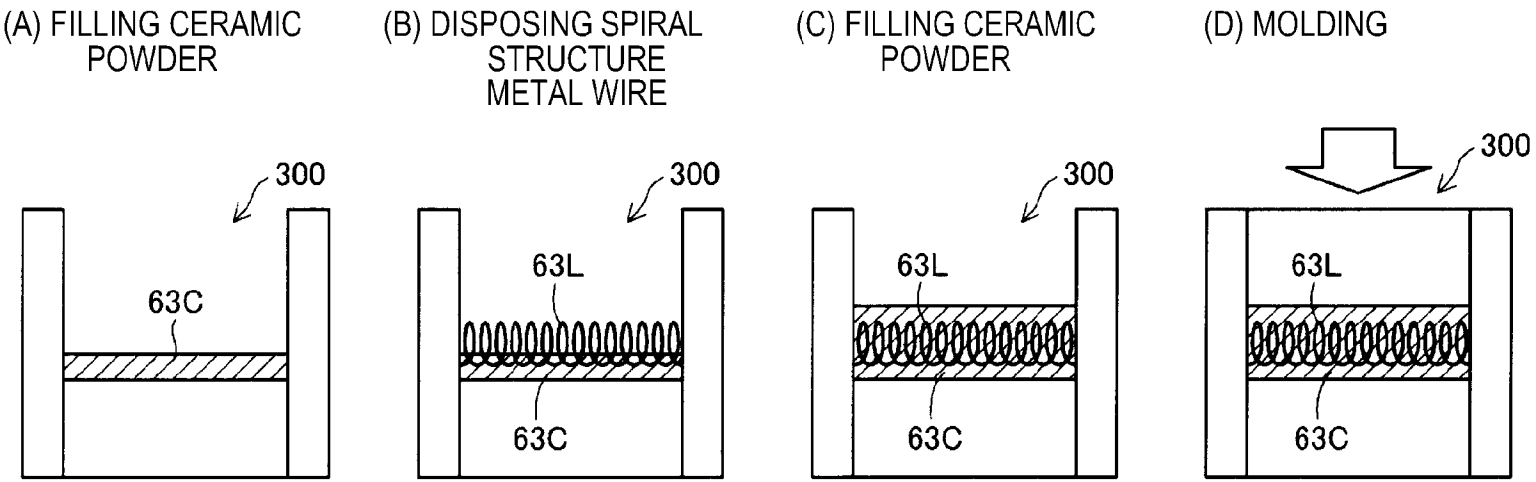
FIG. 4 is an explanatory view illustrating an example of a charging process in process T120.

FIG. 4 is an explanatory view illustrating an example of an inserting process in process T120. First, a mold 300 having a cylindrical cavity suitable for the conductor 63 is prepared and the mold 300 is filled with the powder material of the ceramics phase 63C ((A) in FIG. 4). In this case, mixed powder material in which glass powder such as borosilicate soda glass, powder material of an alkali-containing phase such as a glass raw material (silica, soda, limestone, borax, and the like), and a raw material powder of ceramics are mixed may be used as the powder material of the ceramics phase 63C. After the spiral structure metal wire 63L is mounted on the powder material ((B) in FIG. 4), the powder material of the ceramics phase 63C is further added and the periphery of the spiral structure metal wire 63L is filled with the powder material of the ceramics phase 63C to a degree that the periphery thereof is hidden by the powder material ((C) in FIG. 4). Thereafter, the cylindrical shape is molded at a pressure of 30 MPa to 120 MPa by using the mold 300. In process T130, the conductor 63 is formed by firing the molded body in a range of 850° C. to 1350° C. Here, if the spiral structure metal wire 63L is not exposed to both ends of the conductor 63, it is preferable that the spiral structure metal wire 63L is exposed by polishing the both ends of the conductor 63.

In process T140, the center electrode 4 is inserted into the axial hole 2 of the insulator 3. In process T150, the axial hole 2 of the insulator 3 is filled with the seal powder material for forming the first seal layer 61, the conductor 63, and the seal powder material for forming the second seal layer 62 in this order from the rear end side of the axial hole 2 of the insulator 3, and the axial hole 2 is compressed by inserting a press pin into the axial hole 2. Here, as illustrated in FIG. 2, in a case where the electrical connection portion 60*a* includes the resistor 64, the axial hole 2 is filled with powder material for forming the resistor 64 in process T150. In process T160, the terminal electrode 5 is inserted into the axial hole 2 of the insulator 3 and the entire insulator 3 is disposed inside a heating furnace while pressing the material inserted in the axial hole 2 by the terminal electrode 5 toward the leading end side, and thereby the entire insulator 3 is heated to a predetermined temperature of 700° C. to 950° C. and is fired. As a result, the first seal layer 61 and the second seal layer 62 are sintered, and the conductor 63 is sealed and fixed therebetween.

After process T160, the insulator 3 to which the center electrode 4, the terminal electrode 5, and the like are fixed is combined to the metal shell 7 to which the ground electrode 8 is bonded. Then, manufacturing of the spark plug 1 is completed by bending the tip end portion of the ground electrode 8 to the center electrode 4 side.

EXAMPLES

FIGS. 5A and 5B are diagrams illustrating configurations of the conductor 63 and various test results regarding samples S01 to S28 of the spark plugs as the example of the invention, and samples S31 to S40 of spark plugs as a comparative example. Left side columns of the diagrams illustrate the dimensions and the materials of the spiral structure metal wire 63L used in each sample, the materials of the ceramics phase 63C, alkali metal contents if the ceramics phase 63C contains the alkali-containing phase, and presence or absence of Si, B, and P.

For the dimensions of the spiral structure metal wire 63L, an outer diameter of the entire spiral structure, the spiral pitch, the wire diameter and the height of the spiral structure were respectively set. For the material of the metal wire, elemental metal such as Mo, W, Ti, Al, Zn, Ag, Fe, Ni, Cr, Sn, and Cu and an alloys such as the Permalloy (Fe—Ni alloy), Sendust (Fe—Si—Al alloy), Inconel (Ni—Cr—Fe alloy), SUS316, and SUS405 were used. Here, the purity of the elemental metal need not be so high and typically, it is possible to use the metal wire material having the purity of 95% or more.

For the material of the ceramics phase 63C, various ceramics described above were used. In the samples S14 to S28 of the example, the ceramics phase 63C contains the alkali-containing phase including alkali metal (one or more kinds of Li, Na, K, and Rb) and one or more kinds of Si, B, and P. For a value of the alkali metal content in the ceramics phase 63C, an average value of contents that are obtained by performing ICP emission spectral analysis ten times by using samples obtained by grinding the conductor 63 was used. In the final two samples S39 and S40 of the comparative example, the spiral structure metal wire 63L which does not have the ceramics phase 63C was used.

Right half portions of FIGS. 5A and 5B illustrate results of noise tests before and after a discharge endurance test, and results of a vibration test for the samples S01 to S28 of the example and the samples S31 to S40 of the comparative example. The discharge endurance test was performed by discharging the spark plug 1 at a discharge voltage of 10 kV for 100 hours. The noise test was performed in accordance with "Automobile—Radio Noise Characteristics—Second Part, Measuring Method of Prevention Device and Current Method" of Japanese Automotive Standards Organization D-002-2 (JASO D-002-2). Furthermore, for a measuring object of high frequency noise, three kinds of frequency noise of 30 MHz, 100 MHz, and 200 MHz were used. The vibration test was performed in accordance with "7.4 Impact Resistance Test" of JIS-B8031 and the resistance value between the terminal electrode 5 and the center electrode 4 was measured after the spark plug 1 was fixed and vibration of 20 Hz was applied to the spark plug 1 for one hour. The spark plug 1 was evaluated as failure if the resistance value was 50 kΩ or greater after the vibration test. "NG rate" of a column of the vibration test of FIGS. 5A and 5B illustrates a failure rate for 100 samples. All resistance values between the terminal electrode 5 and the center electrode 4 before the vibration test were within a range of 3.0 kΩ or greater and 20.0 kΩ or smaller.

The following can be understood from the test results illustrated in FIGS. 5A and 5B.

(1) In the spiral structure metal wire 63L of the samples S01 to S28 of the example, the wire diameter is 0.1 mm or greater and 0.5 mm or smaller, the outer diameter of the spiral structure is 1.0 mm or greater and 3 mm or smaller, the pitch is 0.3 mm or greater and 1 mm or smaller, and the height is 8 mm or greater and 30 mm or smaller. In the samples S01 to S28, the noise before the discharge endurance test is at most 56 dB and is not excessively high, and sufficient noise reduction effect is obtained. Furthermore, even after the discharge endurance test, the noise is not increased so much and sufficient noise reduction effect can be maintained.

(2) In the samples S31 to S38 among the samples S31 to S40 of the comparative example, all dimensions of the spiral structure metal wire 63L are out of the preferable range described above. That is, in the samples S31 and S32, the outer diameter is out of the preferable range (1.0 mm to 3 mm) In the samples S33 and S34, the pitch is out of the preferable range (0.3 mm to 1 mm) In the samples S35 and S36, the wire diameter is out of the preferable range (0.1 mm to 0.5 mm) In the samples S37 and S38, the height is out of the preferable range (8 mm to 30 mm) In the samples S31 to S38, the noise before the discharge endurance test is high at 62 dB or greater and the noise reduction effect is insufficient. Furthermore, in the samples S31 to S38, the failure rate of the resistance value after the vibration test is 24% and vibration resistance is also inferior to the samples S01 to S28 of the example. The samples S39 and S40 of the comparative example do not have the ceramics phase 63C, and therefore, are not preferable particularly in that the vibration resistance is low. The reason for this can be estimated that the spiral structure metal wire 63L is damaged by the vibration if the ceramics phase 63C does not exist.

(3) In the samples S09 to S28 of the example, the material of the spiral structure metal wire 63L is a metal or an alloy, which includes one or more kinds of elements of Zn, Fe, Ni, Ag, Cr, Sn, and Cu, and the samples S09 to S28 are preferable in that an increasing rate of the noise after the endurance test is lower than that of the samples S01 to S08 in which the material of the spiral structure metal wire 63L is Mo, W, Ti, or Al.

(4) In the samples S14 to S28 of the example, the ceramics phase 63C contains alkali metal, silicon (Si), boron (B), and phosphorus (P). Therefore, the samples S14 to S28 are preferable in that vibration resistance is higher than that of the samples S01 to S13 in which those components are not contained. It is considered that elements such as the alkali metal, Si, B, and P are contained in a glass component with which the hollow holes of the conductor 63 are filled. The ceramics phase 63C is densified by filling the hollow holes that can be formed in the ceramics phase 63C with the glass component and the like. Thus, in the vibration test, it is estimated that the ceramics phase 63C can further firmly support the spiral structure metal wire 63L.

(5) In the samples S17 to S28, the alkali metal contents in the ceramics phase 63C is within a range of 0.10 wt % or greater and 6.50 wt % or smaller, and the samples S17 to S28 are preferable in that the noise is lower than that of the samples S14 to S16 in which the alkali metal contents are out of this range and the vibration resistance is further excellent. Particularly, in the samples S17 to S28, the resistance value of the spark plug 1 is not excessively increased and extremely excellent vibration resistance is shown by the vibration test. Moreover, it is further preferable that a range of the alkali metal contents in the ceramics phase 63C is 0.90 wt % or greater and 6.50 wt % or smaller, and it is most preferable that the range thereof is 3.20 wt % or greater and 6.50 wt % or smaller.

(6) In the samples S22 to S28, the ceramics phase 63C contains Fe-containing oxide of one or more kinds of FeO, $Fe_2O_3$, and ferrite, and the samples S22 to S28 are preferable in that the noise is lower than that of the samples S01 to S21 which do not contain Fe-containing oxide. Moreover, it is further preferable that the ceramics phase 63C contains Fe-containing oxide having ferromagnetism in the viewpoint of increasing a function of the conductor 63 as the inductance component.

(7) In the samples S25 to S28, the ceramics phase 63C contains ferrite and the samples S25 to S28 are preferable in that the noise is lower than that of the samples S01 to S24 which do not contain ferrite. Since ferrite functions as the inductance component, if the ceramics phase 63C containing ferrite is used, it is possible to further increase the noise reduction effect.

C. Modified Embodiments

The invention is not limited to the example or embodied example described above and can be realized in various modes without departing the gist of the invention.

Modified Embodiment 1

In the embodiments described above, the entire spiral structure metal wire 63L has the spiral structure. However, the spiral structure metal wire 63L may have a part in which the spiral structure does not exist (for example, a linear rod-shaped portion). That is, the spiral structure metal wire 63L may have the spiral structure portion in at least a portion thereof. However, if the entire spiral structure metal wire 63L has the spiral structure, it is preferable in that the noise reduction effect is increased to the maximum.

Modified Embodiment 2

With respect to the spark plug, the invention can be applied to a spark plug having various configurations other than that illustrated in FIGS. 1 and 2.

The invention provides illustrative, non-limiting aspects as follows:

(1) According to an aspect of the invention, there is provided a spark plug including: an insulator having an axial hole extending in an axial direction; a center electrode held at one end side of the axial hole; a terminal electrode held at the other end side of the axial hole; an electrical connection portion electrically connecting the center electrode and the terminal electrode inside the axial hole; and a metal shell accommodating the insulator, wherein the electrical connection portion includes a conductor including a ceramic phase and a metal wire having a spiral structure portion, wherein the metal wire has a wire diameter of 0.1 mm or greater and 0.5 mm or smaller, and wherein the spiral structure portion of the metal wire is configured such that an outer diameter thereof is 1.0 mm or greater and 3 mm or smaller, a pitch thereof is 0.3 mm or greater and 1 mm or smaller, and a height thereof is 8 mm or greater and 30 mm or smaller.

Accordingly, since the metal wire has a spiral structure portion, a noise reduction effect as an inductance component is provided, and further, there is no fear that the noise reduction effect is reduced with time as compared to a printed electrode, metal powder, carbon powder, and the like. Furthermore, although wire disconnection may occur due to vibration in a case of providing only the metal wire, since the metal wire is fixed by the ceramic phase, it is possible to reduce a possibility of the wire disconnection. If a wire diameter of the metal wire is 0.1 mm or greater, it is possible to make occurrence of wire disconnection difficult. If the wire diameter of the metal wire is greater than 0.5 mm, contact between the wire members is likely to occur when an oxide film is generated on a surface of the metal wire. Thus, the noise reduction effect as the inductance component may be insufficient. If an outer diameter of the spiral structure portion is 1.0 mm or greater, processing can be easily performed and cost thereof is reduced. Furthermore, if the outer diameter is 3 mm or smaller, the spiral structure portion can easily enter an axial hole of an insulator. Furthermore, if a pitch of the spiral structure portion is 0.3 mm or greater, a capacity component of the spiral structure metal wire can be sufficiently reduced, and if the pitch of the spiral structure portion is 1 mm or smaller, obtained sufficient number of windings can be obtained. Thus, the noise reduction effect as the inductance component can be sufficiently obtained. If a height of the spiral structure portion is 8 mm or greater, the noise reduction effect as the inductance component can be sufficiently obtained. If the height of the spiral structure portion is 30 mm or smaller, it is possible to easily manufacture the spiral structure portion and to reduce the cost thereof (2) In the above spark plug, the metal wire may be a metal or an alloy, which includes one or more elements of Zn, Fe, Ni, Ag, Cr, Sn, and Cu.

Accordingly, since the metal wire formed of such a material is used, it is possible to prevent a noise resistance characteristic from being degraded with time.

(3) In the above spark plug, the ceramic phase may include an alkali-containing phase containing alkali metal oxide and oxide of one or more elements of Si, B, and P.

Accordingly, since an alkali-containing phase has a function of filling and densifying a plurality of hollow holes that may be formed in the ceramic phase, it is possible to increase the noise reduction effect.

(4) In the above spark plug, a content ratio of the alkali metal in the ceramic phase may be within a range of 0.1 wt % or greater and 6.5 wt % or smaller in terms of an oxide.

Accordingly, since the content ratio the alkali metal is 0.1 wt % or greater in terms of an oxide, it is possible to increase the effect of densifying the ceramic phase and to reduce the possibility of the wire disconnection of the spiral structure metal wire by a vibration when the spark plug receives the vibration. Furthermore, since the content ratio of the alkali metal be 6.5 wt % or smaller, it is possible to suppress a phenomenon that the noise reduction effect is reduced due to a chemical reaction of alkali metal with the metal wire.

(5) In the above spark plug, the ceramic phase may include Fe-containing oxide.

Accordingly, it is possible to further increase the noise reduction effect of the conductor as the inductance component.

(6) In the above spark plug, the Fe-containing oxide may include ferrite.

According to the spark plug, it is possible to further increase the noise reduction effect by ferrite.

Moreover, the invention can be realized in various aspects. The invention can be realized in aspects of the spark plug, a manufacturing method of the spark plug, a manufacturing apparatus of the spark plug, a manufacturing system, and the like.

DESCRIPTION OF REFERENCE NUMERALS AND SIGNS

1, 1*a* SPARK PLUG
2 AXIAL HOLE
3 INSULATOR
4 CENTER ELECTRODE
5 TERMINAL ELECTRODE
7 METAL SHELL
8 GROUND ELECTRODE
9 SCREW PORTION
10 TALC
11 PACKING
12 SMALL DIAMETER PORTION
13 FIRST STEP PORTION
14 INTERMEDIATE DIAMETER PORTION
17 FLANGE PORTION
20 TIP END PORTION
29 NOBLE METAL TIP
60 ELECTRICAL CONNECTION PORTION
60*a* ELECTRICAL CONNECTION PORTION
61 FIRST SEAL LAYER
62 SECOND SEAL LAYER
63 CONDUCTOR
63C CERAMICS PHASE
63L SPIRAL STRUCTURE METAL WIRE
64 RESISTOR
300 MOLD
O AXIAL LINE

Having described the invention, the following is claimed:

1. A spark plug comprising:
an insulator having an axial hole extending in an axial direction;
a center electrode held at one end side of the axial hole;
a terminal electrode held at the other end side of the axial hole;
an electrical connection portion electrically connecting the center electrode and the terminal electrode inside the axial hole; and
a metal shell accommodating the insulator,
wherein the electrical connection portion includes a conductor including a ceramic phase and a metal wire having a spiral structure portion,
wherein the metal wire has a wire diameter of 0.1 mm or greater and 0.5 mm or smaller, and
wherein the spiral structure portion of the metal wire is configured such that an outer diameter thereof is 1.0 mm or greater and 3 mm or smaller, a pitch thereof is 0.3 mm or greater and 1 mm or smaller, and a height thereof is 8 mm or greater and 30 mm or smaller.

2. The spark plug according to claim 1,
wherein the metal wire is a metal or an alloy, which includes one or more elements of Zn, Fe, Ni, Ag, Cr, Sn, and Cu.

3. The spark plug according to claim 1,
wherein the ceramic phase includes an alkali-containing phase containing alkali metal oxide and oxide of one or more elements of Si, B, and P.

4. The spark plug according to claim 3,
wherein a content ratio of the alkali metal in the ceramic phase is within a range of 0.1 wt % or greater and 6.5 wt % or smaller in terms of an oxide.

5. The spark plug according to claim 1,
wherein the ceramic phase includes Fe-containing oxide.

6. The spark plug according to claim 5,
wherein the Fe-containing oxide includes ferrite.

* * * * *